United States Patent [19]

Chang et al.

[11] 4,391,888

[45] Jul. 5, 1983

[54] MULTILAYERED ORGANIC PHOTOCONDUCTIVE ELEMENT AND PROCESS USING POLYCARBONATE BARRIER LAYER AND CHARGE GENERATING LAYER

[75] Inventors: Mike S. H. Chang, Danbury; Michael F. Berman, Bridgeport, both of Conn.

[73] Assignee: Pitney Bowes Inc., Stamford, Conn.

[21] Appl. No.: 331,401

[22] Filed: Dec. 16, 1981

[51] Int. Cl.[3] ..... G03G 5/06

[52] U.S. Cl. ..... 430/57; 430/58; 430/64; 430/96; 430/900

[58] Field of Search ..... 430/57, 58, 64, 90, 430/900

[56] References Cited

U.S. PATENT DOCUMENTS 3,713,821 1/1973 Angelini ..... 430/64 X
4,297,426 10/1981 Sakai et al. ..... 430/58 X
4,301,224 11/1981 Kozima ..... 430/58

FOREIGN PATENT DOCUMENTS 2924865 1/1980 Fed. Rep. of Germany ..... 430/59
2032637 5/1980 United Kingdom ..... 430/59

*Primary Examiner*—John D. Welsh
*Attorney, Agent, or Firm*—Melvin J. Scolnick; Albert W. Scribner; William D. Soltow, Jr.

[57] ABSTRACT

Organic photoconductive elements which are stable and sensitive over a broad range of the spectrum, including the near infrared band, having a charge generating layer and a charge transport layer carried on an electroconductive support are disclosed. The invention involves the use of a first layer between the support and the charge generating layer which is capable of functioning as (i) an adhesive bonding layer on the electroconductive support to provide a receptive and retentive base layer for the charge generating layer and (ii) as a barrier layer to prevent substantially any leakage of charge from the surface of the photoconductor, characterized by the first layer comprising at least one polycarbonate having a weight average molecular weight ranging from about 25,000 to about 45,000, in combination with a charge generating layer that comprises at least one organic pigment which is sensitive to near infrared radiation.

15 Claims, No Drawings

MULTILAYERED ORGANIC PHOTOCONDUCTIVE ELEMENT AND PROCESS USING POLYCARBONATE BARRIER LAYER AND CHARGE GENERATING LAYER

BACKGROUND OF THE INVENTION

The present invention relates to the field of electrophotographic reproduction and, more particularly, to dual layer organic photoconductive elements such as belts, drums, webs, or the like, which are used in machines such as copying machines. Reference is made to U.S. Pat. Nos. 3,615,415, 3,824,099 and 4,150,987 for their discussion of the general field of the present invention and for their disclosure of some of the specific materials and procedures over which the present invention represents an improvement.

Aforementioned U.S. Pat. Nos. 3,824,099 and 4,150,987 relate to dual layer organic photoconductive elements comprising a conductive substrate such as a paper, metallized plastic film or metal plate, supporting two basic layers, namely a charge generating layer and a charge transport layer. Either layer may be adjacent the conductive substrate, and an adhesive bonding layer may be applied to bond the charge generating layer to the electroconductive support.

During use, the photoconductive element is charged, exposed to light passed through or reflected by the lighttransmissive areas of an imaged original sheet to conduct away the charge in the exposed areas, and the charge retaining or unexposed areas are either "inked" with toner which is transferred to a copy sheet or are first transferred to a copy sheet and then "inked" with toner thereon. The toner is fused on the copy sheet to form fixed images corresponding to the images present on the original sheet.

Dual layer organic photoconductive elements were developed in order to provide extremely fast response to light exposure within the visible range of the spectrum. Preferred materials in this respect are diane blue dyes as the charge generating organic chemicals of the charge generating layer and the p-type hydrazones or triaryl pyrazolines as the organic chemicals in the charge transport layer.

Diane blue dyes have the general moiety structure as follows:

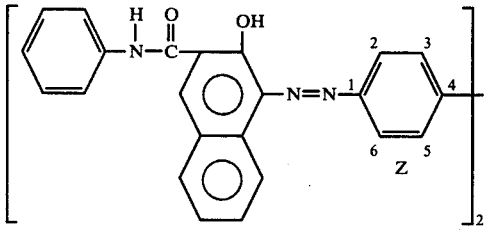

. . . wherein Z is a substituent group on the phenyl ring. Preferably, Z is selected from a group consisting essentially of hydrogen, alkyl, alkoxy and chlorine groups, more preferably hydrogen, methyl, methoxy and chlorine groups; and most preferably a chlorine group. Z is preferably attached to the ring in the 2 or 6 position. The most preferred diane blue, Chlorodiane Blue, has chlorine as the Z group in the 2 position.

Chlorodiane Blue is a preferred charge generating material because it has good stability and provides photoconductive elements having a desired shelf life or duration of storage prior to breakdown and deterioration or loss of its charge generating properties. Chlorodiane Blue also has superior light sensitivity and charge generating properties over a broad portion of the visible light range, i.e., between about 400 mμ and 700 mμ. However, Chlorodiane Blue lacks adequate light sensitivity in the near-infrared range, i.e., between about 680 mμ and 1150 mμ.

Furthermore, charge generating layers based upon Chlorodiane Blue dye or other known charge generating organic chemicals are thin layers which contain the dye in solid particulate form and which therefore are relatively brittle and have low cohesive and adhesive strength.

Various dual layer organic photoconductive elements were also developed in order to provide extremely fast response to light exposure within the near infrared range of the spectrum. For example, it is known that certain organic pigments are sensitive to near IR radiation when they are used as charge generating material in a dual layer organic photoreceptor. These pigments include, for example, squarylium dye (or squaric acid methine dye), metal phthlocyanine such as copper phthlocyanine, and cyanine dyes. However, when these pigments are used in the charge generating layer separately or in a mixed form, photoreceptors thereby prepared exhibit problems with regard to being able to be charged up to a desired surface charge acceptance level. A photoreceptor having this type of problem is basically useless.

In order to provide a bond between the charge generating layer and the conductive support, e.g., commonly a metallized plastic film such as aluminized polyester available from the duPont Company under the trademark Mylar, it is known from Example 6F of U.S. Pat. No. 4,150,987 to apply a bonding layer of a polycarbonate to the conductive support. U.S. Pat. No. 4,150,987 also discloses that polymeric resins, such as polycarbonate resins, can be used as a binder for the charge transport layer, and the fact that other known constituents may be included in the charge transport layer for enhanced adhesion.

We have discovered that known organic photoconductive elements, such as the elements described in the example given above, are still susceptible to delamination and having the problem of brittleness, especially after long term storage, whereby the adhesion between the charge generating layer and the electroconductive support becomes relatively easy to break down and the charge generating layer and charge transport layer also become relatively easy to peel or flake from the support to render the electro-conductive element less desirable for its intended purpose.

Solutions to the brittleness type of problems are described in commonly assigned and copending U.S. patent application Nos. 214,362, filed Dec. 8, 1980, for "Photosensitive Elements and Process" by Chang et al, and 296,667, filed Aug. 26, 1981 for "Photosensitive Elements and Process" by Chang et al. Organic photoreceptors which are stable and sensitive over a broad range of the spectrum, including the near infrared band, are described in commonly assigned and copending U.S. patent application Nos. 214,320, filed Dec. 8, 1980, for "Photosensitive Elements and Process" by Chang et al and 218,389, filed Dec. 19, 1980 for "Photosensitive Elements and Process" by Chang et al.

SUMMARY OF THE INVENTION

The novel dual-layer photoconductive elements of the present invention were developed in order to overcome the prior art problems as outlined above and provide the combined advantages of (i) improved stable photoconductive elements having an extremely fast response to light exposure within a wide range of the spectrum including not only the visible spectrum, but also extending into and including the near-infrared range, i.e., within a broad range of from about 400 mμ to about 1150 mμ and (ii) improved photoreceptors which are substantially strong and resistant to delamination and flaking or peeling of the photosensitive layers from a flexible electroconductive support such as a metallized plastic film.

The present invention is based upon the discovery of an organic photoconductor element which is extremely sensitive to exposure to light rays in the near-infrared region of the spectrum, the element comprising an electroconductive plastic film support, a first layer on the support comprising at least one polycarbonate resin having a weight average molecular weight ranging from about 25,000 to about 45,000, said first layer capable of functioning in a dual capacity as a barrier layer to prevent substantially any leakage of charge from the surface of said photoconductor and as a bonding layer, a charge generating layer comprising a dispersion coated layer formed of at least one diane blue dye containing from about 2 to about 75 percent by weight of at least one squarylium dye based upon the total weight of the charge generating layer, and a charge transport layer comprising a conventional organic chemical capable of transporting electrical charges generated by the charge generating layer in areas of said element exposed to said light rays.

The present invention is also based on the discovery of the use and application of the photoreceptor described herein in a method for forming an electrophotographic image whereby one electrostatically charges in the dark the surface of an organic photoconductive element which is extremely sensitive to exposure to light rays in the near-infrared region of the spectrum, the element comprising an electroconductive plastic film support, a first layer on said support comprising at least one polycarbonate resin having a weight average molecular weight ranging from about 25,000 to about 45,000, said first layer capable of functioning in a dual capacity as a barrier layer to prevent substantially any leakage of charge from the surface of said photoconductor and as a bonding layer, a charge generating layer comprising a dispersion coated layer formed of at least one diane blue dye containing from about 2 to about 75 percent by weight of at least one squarylium dye based upon the total weight of the charge generating layer, and a charge transport layer comprising a conventional organic chemical capable of transporting electrical charges generated by the charge generating layer in areas of said element exposed to said light rays; exposing the photoconductive element to actinic radiation; and discharging the surface of the photoconductive element in an image-wise fashion corresponding to the pattern of actinic radiation to produce a latent electrostatic image thereon.

DESCRIPTION OF THE PREFERRED EMBODIMENTS

In accordance with the present invention, we have found that by the combined use in an organic photoconductor having a charge generating layer and a charge transport layer on an electroconductive support of a polycarbonate resin barrier layer coated underneath the charge generating layer along with certain specific charge generating materials as described herein, we have been able to obtain organic photoconductive elements (i) that are stable and sensitive over a broad range of the spectrum, including the near-infrared region, (ii) that exhibit excellent charge acceptance and reduced dark decay of surface charge, and (iii) that exhibit excellent bonding of the photoconductive material to the substrate thereby substantially eliminating the problems of delamination, brittleness and flaking.

There are several polycarbonate resins that are particularly suitable for use as the barrier layer according to the present invention. It is, however, preferred that the one or more polycarbonate resins be used that have a weight average molecular ranging from about 25,000 to about 45,000, and more preferably from about 30,000 to about 40,000. Examples of some of the types of polycarbonate resins which can be used include poly(oxycarbonyloxy-1,4-phenyleneisopropylidene-1,4-phenylene), poly(oxycarbonyloxyhexamethylene), poly(oxycarbonyloxyhexamethylene), poly(oxycarbonyloxy-2-methyl-1,4-phenylenecyclohexylidene-3-methyl-1,4-phenylene), poly(oxycarbonyloxy-2-methyl-1,4-phenyleneisopropylidene-1,4-phenylene), poly(oxycarbonyloxy-3-methyl-1,4-phenylenebenzylidene-2-methyl-1,4-phenylene), poly(oxycarbonyloxy-1,4-phenylene-2,2-butylidene-1,4-phenylene), poly(oxycarbonyloxy-1,4-phenyleneseisobutylidene-1,4-phenylene), poly[oxycarbonyloxy-1,4-phenylenedi(isopropylidene-1,4-phenylene)], and poly[oxycarbonyloxy-1,4-phenylene(methyl)phenylmethylene-1,4-phenylene]. Some specific examples of the types of commercially available polycarbonate resins having a weight average molecular weight within the range varying from about 25,000 to about 45,000 that can be used in the practice of the present invention include polycarbonate resins, such as Merlon M-50, Merlon M-40, Merlon M-39 and Merlon M-60 (Mobay Chemical Co.) and various Lexan resins (General Electric Co.). We have found that the thicker the polycarbonate barrier layer is, the less the occurrence of dark decay of the surface charge. However, the thickness of this layer cannot be unlimitedly expanded. If the barrier layer is made too thick, the light decay of the surface charge will be affected. We have found that the coating weight of the polycarbonate barrier layer has a preferred coating weight ranging from about 10 mg/ft$^2$ to about 25 mg/ft$^2$, and most preferably from about 10 mg/ft$^2$ to about 20 mg/ft$^2$.

The novel dual-layer organic photoconductive elements of the present invention were developed in order to provide improved sensitive photoconductive elements having an extremely fast response to light exposure within a wide range of the spectrum including not only the visible spectrum, but also extending into the near-infrared range, i.e., within a broad range of from about 400 mμ up to about 1150 mμ in combination with excellent adhesion properties, excellent charge acceptance properties and low dark decay of surface charge as described herein. While charge generating layers containing Chlordiane Blue are only highly sensitive to light exposure within the visible range, i.e., between 400 mμ and 700 mμ and thus are unsuitable for use with certain lasers as a light exposure source, and charge generating layers based upon squarylium dye(s) lack the desired stability and/or high sensitivity of charge generating layers based upon a diane blue such as Chlorodiane Blue, the combination of certain amounts of these charge generating organic chemicals within the same charge generating layer results in a layer which has the stability and excellent sensitivity to light possessed by a diane blue, such as Chlorodiane Blue, but extending into a range of the near-infrared, i.e., within a range of between about 400 mμ and about 1150 mμ, and thus is suitable for use with visible light sources as well as certain near-infrared light sources, such as certain lasers, especially within a spectrum range of about 700 to about 850 mμ, as the light exposure source. Generally, we have found that a charge generating layer comprising a dispersion coated layer formed of at least one diane blue dye containing from about 2 to about 75 percent by weight of at least one squarylium dye (or squaric acid methine dye) based upon the total weight of the charge generating layer is eminently suited for providing the light sensitivity required for the photoconductor defined by the present invention. Examples of preferred squarylium dyes are selected from the group:

1.

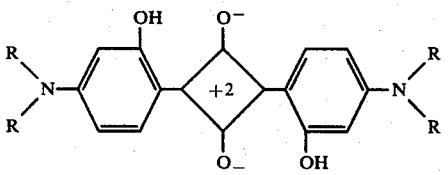

2.

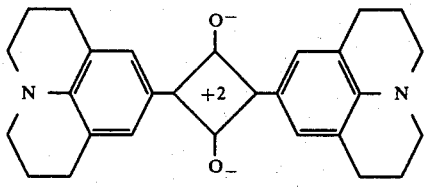

3.

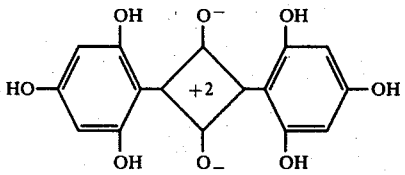

4

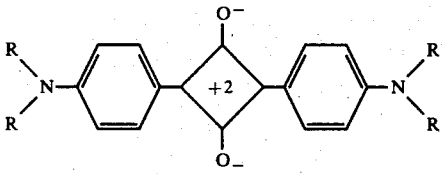

-continued

5.

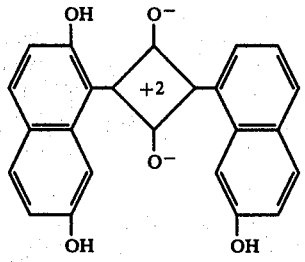

6.

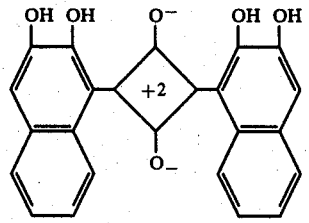

7.

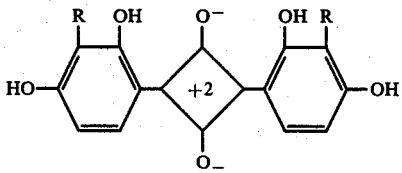

8.

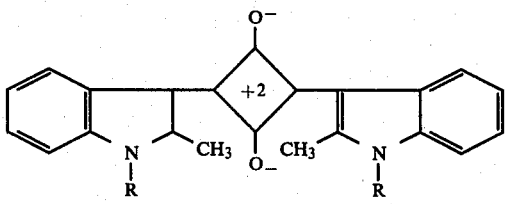

9.

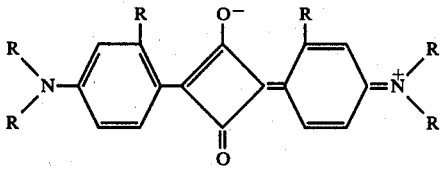

10.

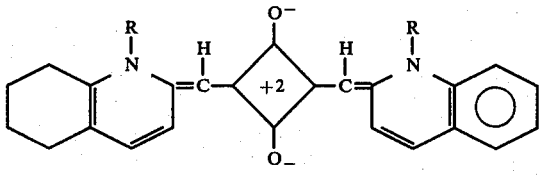

11.

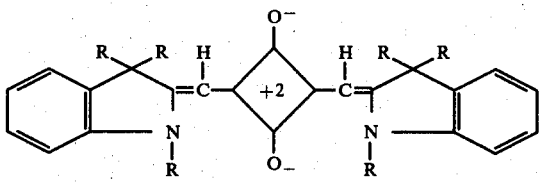

. . . wherein the radical "R" is a methyl or ethyl group. A particularly preferred squarylium dye is 2,4 bis(2-hydroxy-4-dimethylaminophenyl)-1,3-cyclobutadienediylium-1,3-diolate (see formula #1 hereinabove wherein the radical "R" is a methyl group). Other known charge generating squarylium dyes may also be used in place of the preferred dyes listed above.

The charge generating layers of the present invention are preferably formulated and coated by a dispersion technique wherein the pigments (dyes) are mixed with a suitable volatile solvent such as THF, i.e. tetrahydrofuran, preferably at a concentration of 1.0% to 3.0%, and then put in, for example, a ball mill to make a dispersion of the pigments in the solvent. It is this dispersion of pigment in solvent which is then coated onto the substrate to form the charge generating layer.

The charge transport layers suitable for use with the charge generating layers of the present invention, and the method for preparing and applying the same in association with the present charge generating layers, are conventional in the art and the pertinent disclosures of U.S. Pat. Nos. 3,615,415, 3,824,099 and 4,150,987 are incorporated herein by reference. The preferred charge transport organic chemicals are the triaryl pyrazoline compounds of U.S. Pat. No. 3,824,099 such as 1-phenyl-3-[p-diethylaminostyrl]-5-[p-diethylamino phenyl]-pyrazoline, and the hydrazone compounds of U.S. Pat. No. 4,150,987, such as p-diethylaminobenzaldehyde-(diphenyl hydrazone). The charge transfer chemical is dispersed or dissolved in a solution of one or more resinous binder materials and the charge transport layer is applied and dried by evaporation of the volatile solvent, in a known manner.

The following Example is given as an illustration of a preferred embodiment of the present invention and should not be considered limitiative.

EXAMPLE

The general procedure disclosed in Example I of U.S. Pat. No. 4,150,987 was followed to prepare an organic photoconductive element according to the present invention except that a polycarbonate barrier layer and a charge generating layer were formulated and coated in the manner described hereinbelow. The same general procedure was followed to produce a three-layered organic photoconductive element according to the invention of said Patent. Said element was used as a control for comparison purposes to demonstrate the improved results made possible by the present invention.

Barrier Layer

(a) Polycarbonate Formulation

1% (by weight) total solids comprising 99% M-50 (Mobay Chemical Co.) polycarbonate and 1% Santicizer 334-F (Monsanto Chemical Co.) plasticizer in a solvent system comprising 9/1 weight ratio THF (tetrahydrofuran)/Toluene respectively.

(b) Coating Procedure (i) The above formulation was filtered one time with #4 Whatman filter paper.

(ii) 100 ml. of the filtered formulation was added to a flat menescus coating pan.

(iii) The polycarbonate barrier layer was then meniscus coated onto an aluminized Mylar (duPont trademark for polyethylene terephthalate) substrate at about 10 rpm using a meniscus coater and a web speed of about 11 ft/min.

(iv) The coating speed was retained until the coating procedure was completed, and then the coating (about 14–17 mg/ft$^2$) was immediately dried under an infrared lamp for about 11 minutes.

Charge Generating Layer

(a) Formulation:

A dispersion of a 2% (by weight) total solids dye system comprising of (by weight) 50% 2,4-bis-(2-hydroxy-4-dimethylaminophenyl)-1,3-cyclobutadienediylium-1,3-diolate (hydroxy squarylium) and 50% 4-4"[-(3,3'-dichloro-4,4'-biphenylene)bis(azo)]-bis[3-hydroxy-2-naphlhanide] (Chlorodian Blue) in a solvent system of 100% THF (tetrahydrofuran) was prepared by placing this mixture in an amber bottle with approximately 1.0 m.m. diameter stainless steel balls, and ball milling the mixture for about 8 hours. This was sufficient to form a dispersion of the solids in the solvent.

(b) Coating Procedure (i) The above formulation was filtered one time with #4 Whatman filter paper.

(ii) A layer of the charge generating formulation was coated (about 1–5 mg/ft$^2$) over the barrier layer using a #20 wire rod. The layer was allowed to dry in air.

Thereafter, a hydrazone charge transfer layer was formulated and applied over the dye layer in the manner disclosed in Example I of U.S. Pat. No. 4,150,987 having a coating weight of about 1.8 gm/ft$^2$.

Photoconductive elements prepared in accordance with Example I of U.S. Pat. No. 4,150,987 (control sample) and elements prepared in accordance with the present invention as described above, were tested for adhesion properties. The adhesion properties of the control sample was rated as a "Failure" while that of the samples prepared in accordance with the present invention was rated "Pass" based on subjecting these samples to a critical adhesion test as described below:

Critical Adhesion Test—The organic layered photoconductor is foled 180° with the photoconductor coating facing inward. A force is applied along the folding edge just sufficient in magnitude to creep the Mylar substrate. If the coating becomes delaminated or falls apart due to this action, the adhesion of the coating is rated as a "Failure"; if it is intact, i.e., essentially no delamination or falling apart, it is rated as a "Pass." It is noted that photoconductive elements prepared in accordance with the present invention and subject to this test not only passed, but appeared to be in excellent condition.

Photoconductive elements prepared with a charge generating layer of hydroxy squarylium and Chlorodiane Blue and an adhesive layer of a polyester (control sample) and elements prepared as described above were also subject to corona wire charging under the same conditions. The surface voltage of elements prepared in accordance with the present invention were able to be charged up to 650–700 volts, while the surface voltage of control sample could only be charged up to about 20 to 100 volts.

Variations and modifications of the present invention will be apparent to those skilled in the art in the light of the present disclosure and within the scope of the present claims.

We claim:

1. An organic photoconductive element which is extremely sensitive to exposure to light rays in the near-infrared region of the spectrum, said element comprising an electroconductive plastic film support; a first layer on said support comprising at least one polycarbonate resin having a weight average molecular weight ranging from about 25,000 to about 45,000, said first layer capable of functioning in a dual capacity as a barrier layer to prevent substantially any leakage of charge from the surface of said photoconductor and as a bonding layer; a charge generating layer comprising a dispersion coated layer formed of at least one diane blue dye containing from about 2 to about 75 percent by weight of at least one squarylium dye based upon the total weight of the charge generating layer; and a charge transport layer comprising a conventional organic chemical capable of transporting electrical charges generated by said charge generating layer in areas of said element exposed to said light rays.

2. An organic photoconductive element according to claim 1 wherein said polycarbone resins are selected from the group consisting of poly(oxycarbonyloxy-1,4-phenyleneisopropylidene-1,4-phenylene), poly(oxycarbonyloxyhexamethylene), poly(oxycarbonyloxyhexamethylene), poly(oxycarbonyloxy-2-methyl-1,4-phenylenecyclohexylidene-3-methyl-1,4-phenylene), poly(oxycarbonyloxy-2-methyl-1,4-phenyleneisopropylidene-1,4-phenylene), poly(oxycarbonyloxy-3-methyl-1,4-phenylenebenzylidene-2-methyl-1,4-phenylene), poly(oxycarbonyloxy-1,4-phenylene-2,2-butylidene-1,4-phenylene), poly(oxycarbonyloxy-1,4-phenyleneseisobutylidene-1,4-phenylene), poly[oxycarbonyloxy-1,4-phenylenedi(isopropylidene-1,4-phenylene)], and poly[oxycarbonyloxy-1,4-phenylene(methyl)phenylmethylene-1,4-phenylene].

3. A photoconductive element according to claims 1 or 2 wherein said diane blue dye comprises chlorodiane blue.

4. A photoconductive element according the claim 1 wherein said squarylium dye is 2,4-bis-(2-hydroxy-4-dimethylaminophenyl)-1,3-cyclobutadienediylium-1,3-diolate.

5. A photoconductive element according to claim 2 wherein the percent by weight of said squarylium dye varies from about 25 to about 60 percent based upon the total weight of the charge generating layer.

6. A photoconductive element according to claim 1 wherein said electroconductive support comprises a metallized plastic film.

7. A photoconductive element according to claims 1 or 2, wherein the weight average molecular weight of said polycarbonate resins varies from about 30,000 to about 40,000.

8. A photoconductive element according to claims 1 or 2, wherein said organic chemical of the charge transport layer is selected from the group consisting of triaryl pyrazolines and hydrazones.

9. A method for forming an electrophotographic image comprising:

(a) electrostatically charging in the dark the surface of an organic photoconductive element which is extremely sensitive to exposure to light rays in the near-infrared region of the spectrum, said element comprising an electroconductive plastic film support; a first layer on said support comprising at least one polycarbonate resin having a weight average molecular weight ranging from about 25,000 to about 45,000; said first layer capable of functioning in a dual capacity as a barrier layer to prevent substantially any leakage of charge from the surface of said photoconductor and as a bonding layer; a charge generating layer comprising a dispersion coated layer formed of at least one diane blue dye containing from about 2 to about 75 percent by weight of at least one squarylium dye based upon the total weight of the charge generating layer, and a charge transport layer comprising a conventional organic chemical capable of transporting electrical charges generated by said charge generating layer in areas of said exposed to said light rays;

(b) exposing the photoconductive element to actinic radiation; and (c) discharging said surface of the photoconductive element in an image-wise fashion corresponding to the pattern of actinic radiation to produce a latent electrostatic image thereon.

10. A method according to claim 9 wherein said polycarbonate resins are selected from the group consisting of poly(oxycarbonyloxy-1,4-phenyleneisopropylidene-1,4-phenylene), poly(oxycarbonyloxyhexamethylene), poly(oxycarbonyloxyhexamethylene), poly(oxycarbonyloxy-2-methyl-1,4-phenylenecyclohexylidene-3-methyl-1,4-phenylene), poly(oxycarbonyloxy-2-methyl-1,4-phenyleneisopropylidene-1,4-phenylene), poly(oxycarbonyloxy-3-methyl-1,4-phenylenebenzylidene-2-methyl-1,4-phenylene), poly(oxycarbonyloxy-1,4-phenylene-2,2-butylidene-1,4-phenylene), poly(oxycarbonyloxy-1,4-phenyleneseisobutylidene-1,4-phenylene), poly[oxycarbonyloxy-1,4-phenylenedi(isopropylidene-1,4-phenylene)], and poly[oxycarbonyloxy-1,4-phenylene(methyl)phenylmethylene-1,4-phenylene].

11. A method according to claims 9 or 10 wherein said diane blue dye comprises Chlorodiane Blue.

12. A method according to claims 9 or 10, wherein said squarylium dye is 2,4-bis-(2-hydroxy-4-dimethylaminophenyl)-1,3-cyclobutadienediylium-1,3-diolate.

13. A method according to claim 10 wherein the percent by weight of said squarylium dye varies from about 25 to about 60 percent based upon the total weight of the charge generating layer.

14. A method according to claims 9 or 10, wherein the weight average molecular weight of said polycarbonate resins varies from about 30,000 to about 40,000.

15. A method according to claims 9 or 10 wherein said organic chemical of the charge transport layer is selected from the group consisting of triaryl pyrazolines and hydrazones.

* * * * *